US011511452B2

(12) United States Patent
Yoshikawa

(10) Patent No.: US 11,511,452 B2
(45) Date of Patent: Nov. 29, 2022

(54) PUNCHING DEVICE

(71) Applicant: TISM Co., LTD., Kasugai (JP)

(72) Inventor: Katsuharu Yoshikawa, Kasugai (JP)

(73) Assignee: TISM CO., LTD, Kasugai (JP)

( * ) Notice: Subject to any disclaimer, the term of this patent is extended or adjusted under 35 U.S.C. 154(b) by 46 days.

(21) Appl. No.: 16/607,811

(22) PCT Filed: Apr. 18, 2018

(86) PCT No.: PCT/JP2018/015976
§ 371 (c)(1),
(2) Date: Oct. 24, 2019

(87) PCT Pub. No.: WO2018/198900
PCT Pub. Date: Nov. 1, 2018

(65) Prior Publication Data

US 2020/0130217 A1 Apr. 30, 2020

(30) Foreign Application Priority Data

Apr. 25, 2017 (JP) ..... JP2017-085848

(51) Int. Cl.
*B26D 7/18* (2006.01)
*B26F 1/04* (2006.01)

(52) U.S. Cl.
CPC ..... *B26D 7/1863* (2013.01); *B26F 1/04* (2013.01)

(58) Field of Classification Search
CPC ..... B26D 7/1863; B25J 15/0625; B26F 1/04
(Continued)

(56) References Cited

U.S. PATENT DOCUMENTS 2,646,095 A * 7/1953 Schreiber ..... A24B 7/12 241/47
3,194,095 A * 7/1965 Buck ..... B26D 7/1863 83/100

(Continued)

FOREIGN PATENT DOCUMENTS

DE 3420763 A1 12/1985
JP 7-280 1/1995

(Continued)

OTHER PUBLICATIONS

PCT International Search Report for PCT/JP2018/015976, dated Jul. 24, 2018, 3 pgs.

(Continued)

*Primary Examiner* — Kenneth E Peterson
(74) *Attorney, Agent, or Firm* — Patterson Thuente Pedersen, P.A.

(57) ABSTRACT

A punching device is provided with a punching head, a vacuum apparatus, a suction flow passage, and a suction switching apparatus. The punching head includes a plurality of hollow rods that move vertically, and punching tools each having an axially extending through hole provided at each front end of the hollow rods. The vacuum apparatus serves to suck punched chips generated during the punching process of the punching head. The suction flow passage selectively communicates the through holes of the punching tools with the vacuum apparatus. The suction switching apparatus changes a path of the suction flow passage so that the suction flow passage communicates only with a hollow rod performing a punching process, among the plurality of hollow rods.

15 Claims, 13 Drawing Sheets

(58) Field of Classification Search
USPC ..... 83/164
See application file for complete search history.

(56) References Cited

U.S. PATENT DOCUMENTS

| | | | | | |
|---|---|---|---|---|---|
| 3,680,419 | A * | 8/1972 | Stoop | B26D 7/1863 | 83/98 |
| 3,724,980 | A * | 4/1973 | Lassmann | A21C 11/10 | 425/102 |
| 4,599,926 | A * | 7/1986 | Carlson, Jr. | B26D 7/1863 | 83/100 |
| 4,793,657 | A * | 12/1988 | Mense | B25J 15/0616 | 271/91 |
| 5,609,377 | A * | 3/1997 | Tanaka | B65G 47/918 | 294/65 |
| 5,778,806 | A | 7/1998 | Badillo | | |
| 5,782,156 | A * | 7/1998 | Collins | B26D 7/018 | 101/415.1 |
| 5,836,226 | A | 11/1998 | Tsuji et al. | | |
| 5,906,702 | A * | 5/1999 | Crawford, Jr. | B29C 66/1122 | 156/251 |
| 6,860,534 | B2 * | 3/2005 | Vogel | B65G 47/918 | 294/188 |
| 6,913,177 | B2 * | 7/2005 | Steiner | B26D 7/1818 | 225/104 |
| 10,814,498 | B2 * | 10/2020 | Wagner | B66C 1/0218 | |
| 11,059,186 | B2 * | 7/2021 | Schneider | B25J 15/0052 | |
| 2016/0244274 | A1 * | 8/2016 | Parish | B65G 51/20 | |

FOREIGN PATENT DOCUMENTS

| | | | |
|---|---|---|---|
| JP | 07194865 | | 1/1995 |
| JP | 9-234698 | A | 9/1997 |
| JP | 2000-108095 | A | 4/2000 |
| JP | 2018-24089 | A | 2/2018 |
| WO | WO 2015/076389 | | 5/2015 |

OTHER PUBLICATIONS

English translation of PCT International Search Report for PCT/JP2018/015976, dated Jul. 24, 2018, 2 pg.

PCT Written Opinion of the ISA for PCT/JP2018/015976, dated Jul. 24, 2018, 4 pgs.

Extended European Search Report for Application EP 18790828.0, dated Dec. 14, 2020, 6 pgs.

* cited by examiner

PUNCHING DEVICE

CROSS-REFERENCE TO RELATED APPLICATIONS

The present application is a U.S. National Phase entry of, and claims priority to, PCT Application No. PCT/JP2018/015976, filed Apr. 18, 2018, which claims priority to Japanese Patent Application No. 2017-085848, filed Apr. 25, 2017, both of which are incorporated herein by reference in their entireties for all purposes.

TECHNICAL FIELD

The present invention relates to a punching device.

BACKGROUND ART

Known embroidery sewing machines perform an embroidery or a punching process on/in a workpiece. For example, an embroidery sewing machine disclosed in WO2015/076389 includes an embroidery head with a plurality of needles, a punching head with a plurality of punches, and a frame. The embroidery head and the punching head are arranged side by side at an interval. The frame serves to hold a workpiece such as a leather sheet on a sewing machine table. The frame is configured to move back and forth, right and left while performing an embroidery and a punching process.

FIGS. 11 to 14 show an embroidery sewing machine having a punching head of this type. As shown in FIG. 11, the embroidery sewing machine is provided with two pairs of an embroidery head S and a punching head P for performing a punching process. The embroidery heads S and the punching heads P are arranged adjacent to each other and are provided on a front surface of an upper frame 2 of an embroidery sewing machine main body 1. The embroidery head S is capable of multi-color embroidering by performing sewing while selecting any of a plurality of color threads. Each hook base 3 includes a well-known rotary hook configured to perform a sewing operation in cooperation with a needle. Each hook 3 is disposed on a lower frame 4 positioned below each of the embroidery heads S. Each receiving base 5 is configured to receive each punch (punching tool) 8 (see FIGS. 12 and 13). Each receiving base 5 is also disposed on the lower frame 4 positioned below each of the punching heads P.

As shown in FIG. 12, the punching head P is configured to exclude a take-up lever and a thread guide, etc. from a needle bar case, which are present in the well-known embroidery head S. The punching head P is equipped with a plurality of vertically reciprocating needle bars 6, similar to the embroidery head S. The needle bars 6 selected by a change device 7 (see FIG. 11) are switched and moved into a use position. The change device 7 is installed on the front surface of the upper frame 2. Each needle bar 6 is hollow and a punch (punching tool) 8 is attached to the lower end of each needle bar 6, instead of a sewing needle. Since sewing needles are not attached to needle bars 6 of the punching head P, they are hereinafter referred to as vertically reciprocating needle bars.

As shown in FIG. 13, the punch (punching tool) 8 is formed with a vertically penetrating through hole 8*a*. A lower end of the through hole 8*a* has a perforation blade 8*b* at an inner peripheral edge thereof. An upper end of the punch (punching tool) 8 has an attachment portion 8*c*. The attachment portion 8*c* is inserted into a lower end of the vertically reciprocating needle bar 6 and is fastened by a screw 10 at a needle holder 9, so as to fix the punch (punching tool) 8 to the vertically reciprocating needle bar 6. Various types of punches (punching tools) 8 having a different hollow shapes or different sizes are available to replace the above mentioned punches (punching tools) 8.

As shown in FIG. 12, each tube 11 is attached to corresponding upper ends of the vertically reciprocating needle bars 6 and discharges punched chips via the through holes 8*a* of the punches (punching tools) 8. Referring to FIG. 11, each of the tubes 11 is supported on a thread stand 12 installed on an upper surface of an upper frame 2. Each of the tubes 11 extends upward from the punching head P and extends above the upper surface of the thread stand 12 and to a rear side. Each tube 11 also extends in a downward direction. As shown in FIG. 14, manifold blocks 14 are provided for each of the punching heads P and at a rear side position of the upper surface of the thread stand plate 13. The manifold blocks 14 are formed with the same number of connection openings (not shown) as the corresponding vertically reciprocating needle bars 6. Each of the tubes 11 is connected to each of the connection openings. A front side of the manifold block 14 opposite to the tube connection openings is connected to a branch hose 15. Each branch hose 15 is connected to a main hose 16. The main hose 16 is connected to a vacuum apparatus 50. Therefore, punched chips produced by the punching process of each punching heads P are discharged to the outside by the suction of the vacuum apparatus 50. For example, the punching chips pass through suction flow passage defined by the through holes 8*a* of the punches (punching tools) 8, then through the hollow portions in the vertically reciprocating needle bars 6, through the hollows of the tubes 11, and finally through the insides of the branch hoses 15 and the inside of the main hose 16.

However, in the above-described method of discharging the punched chips, the punches not currently performing the perforation operation also carry out the suction process, in addition to the ones actually performing the perforation operation. As a result, there is a problem of low airtightness in the suction passages, resulting in a poor suction efficiency of the vacuum apparatus 50. There is also a problem of a significant reduction in suction power as the number of the punching heads increases.

Therefore, there has conventionally been a need for a punching device with a high airtightness in a suction flow passage, and an increased suction efficiency when discharging chips punched by punching tools.

SUMMARY OF THE INVENTION

According to one aspect of the present disclosure, a punching device includes a punching head, a suction apparatus, a suction flow passage, and a suction switching apparatus. The punching head includes hollow rods that move vertically and punching tools provided respectively at front ends of the hollow rods. Each of the punching tools has an axially extending through hole. The suction apparatus is configured to suck punched chips generated by the punching head during a punching process. The suction passages communicate the through holes of the punching tools with the suction apparatus. The suction switching apparatus is configured to change a path of the suction flow passage so that only the hollow rod or hollow rods that perform the punching process, among the hollow rods, is suctioned.

Therefore, the hollow rods which are not performing the punching process among the hollow rods, will not be suctioned. Thereby, the suction power of the suction apparatus can be focused on the hollow rod or rods performing the punching process. As a result, an airtightness in the suction passage when discharging the punched chips by the punching tools may be enhanced and the suction efficiency of the suction apparatus may be improved.

According to another aspect of the present disclosure, the suction switching apparatus may have a flow passage switching mechanism configured to change the path of the suction flow passage in accordance with the selected hollow rod or rods, among the plurality of hollow rods. As a result, only the hollow rod or rods performing the punching process, among the hollow rods, is suctioned.

According to another aspect of the present disclosure, the suction switching apparatus may further include a connection/disconnection switching mechanism. The connection/disconnection switching mechanism is positioned at an intermediate portion of the path of the suction flow passage, which is changed by the flow passage switching mechanism. The connection/disconnection switching mechanism is configured to reciprocally move in an extending direction of the suction flow passage so as to change the path of the suction flow passage between a connected state and a disconnected state, with respect to the selected hollow rod or rods. Therefore, the path of the suction flow passage is physically changed to be connected to or disconnected from the selected hollow rod or rods.

According to another aspect of the present disclosure, when the connection/disconnection switching mechanism disconnects the suction flow passage, the flow passage switching mechanism changes the path of the suction flow passage in accordance with a newly selected hollow rod or rods, among the plurality of hollow rods. Therefore, this structure may prevent contact members from being worn and may reduce the load applied to a drive source, etc., as compared to a switching structure that changes a path of the flow passage without disconnecting the flow passage.

According to another aspect of the present disclosure, the flow passage switching mechanism may include a connection member and a rotary member. The connection member may have connection openings disposed along a circular arc line. The rotary member may include a suction opening that can communicate with one of the connection openings, in accordance with a rotation of the rotary member about a center of the circular arc line as a rotational center thereof. As a result, this structure may be more compact than a structure in which connection openings are arranged along a straight line. Further, the flow passage switching mechanism is structured to shift the suction opening relative to the connection openings using a rotary shaft of the drive source. As a result, the flow passage switching mechanism can be compact without adopting a complex structure.

According to another aspect of the present disclosure, the suction switching apparatus may further include a connection/disconnection switching mechanism. The connection/disconnection switching mechanism may shift the suction opening so as to be connected with or disconnected from each of the connection openings, by moving the rotary member reciprocally and coaxially along the rotational center. Thereby, the contact member provided with the suction opening is perpendicularly abutted against one of the connection openings. In this way, the suction opening and the connection opening are connected without a gap, so that an airtightness can be ensured. In addition, this structure may prevent the contact member from being worn and may reduce the load applied to a drive source, etc., as compared to a switching structure in which the path of the suction flow passage is changed without the suction flow passage being disconnected.

According to another aspect of the present disclosure, the suction switching apparatus may be provided for each of the punching heads. Therefore, this structure can be flexibly adapted to the change in the number of the punching heads and the suction processing capability can also be ensured.

DETAILED DESCRIPTION

Hereinafter, embodiments for carrying out the present invention will be described with reference to FIGS. 1 to 10. A punching device provided at a sewing machine will be described as one embodiment of the present punching device. When describing the present embodiments with reference to FIGS. 1 to 10, the same components as those of the conventional components are denoted by the same reference signs shown in FIGS. 11 to 14, and the detailed description thereof may be omitted.

First Embodiment

Figure 1:
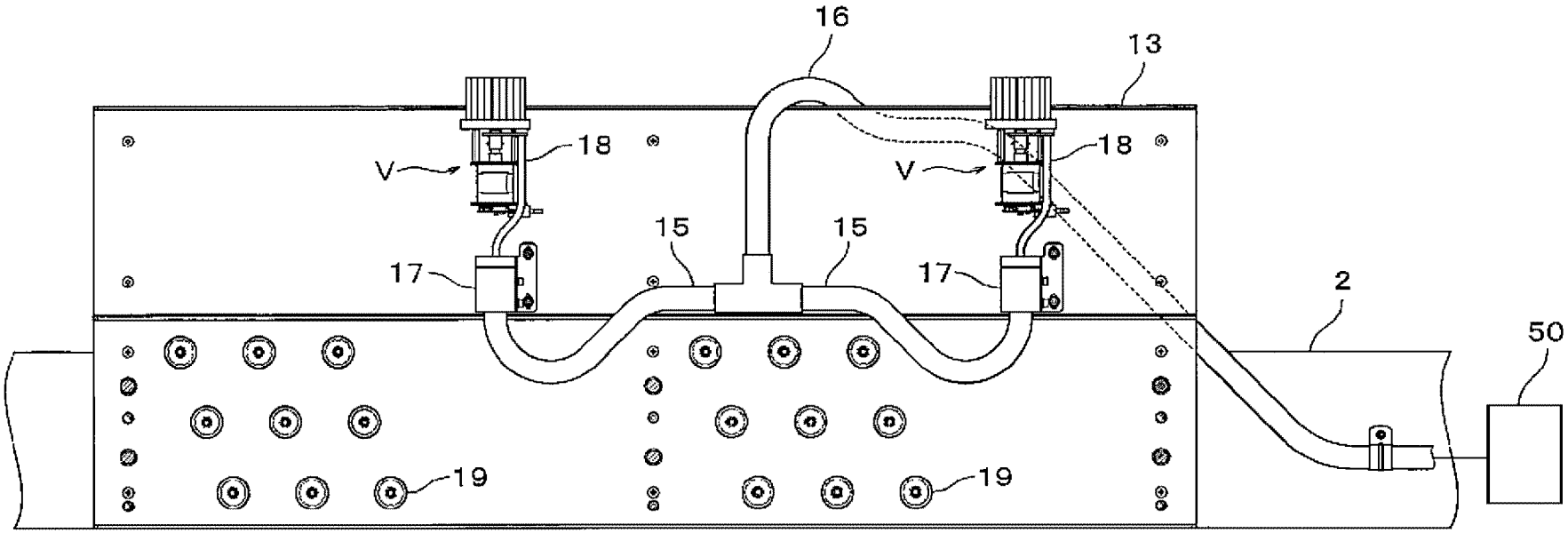
FIG. 1 is a plan view of a suction switching apparatus of a punching device according to a first embodiment.

As shown in FIG. 1, a piping arrangement includes a vacuum apparatus 50 (described as an embodiment of a suction apparatus), a main hose 16 leading to the vacuum apparatus 50, and branch hoses 15 connected to a suction switching apparatus V of a punching device. The punching device of the first embodiment is similar to that of the conventional structure illustrated in FIGS. 11 to 14. Each of the branch hoses 15 branches off of the main hose 16. Each of the branch hoses 15 is connected to the corresponding connection block 17 of the punching heads P (e.g., see FIG. 12). One face (e.g., the front face) of the connection block 17 is formed with connection one or more opening to which the branching hoses 15 are connected. An opposite face (e.g., the rear face) of the connection block 17 is formed with a connection opening having a small diameter. The connection opening with a small diameter (not shown) is connected to a tube 18 leading to the suction switching apparatus V. Thread spools 19 are placed at a front region of a thread stand plate 13. Threads to be fed to the sewing needles of the embroidery heads S are wound on the thread spools 19. Each of the suction switching apparatuses V is arranged behind each of the connection blocks 17 at a predetermined interval. The suction switching apparatus V comprises a flow passage switching means (described as an embodiment of a flow passage switching mechanism) and a connection/disconnection switching means (described as an embodiment of a connection/disconnection switching mechanism).

Flow Passage Switching Means (Flow Passage Switching Mechanism)

Figure 2:
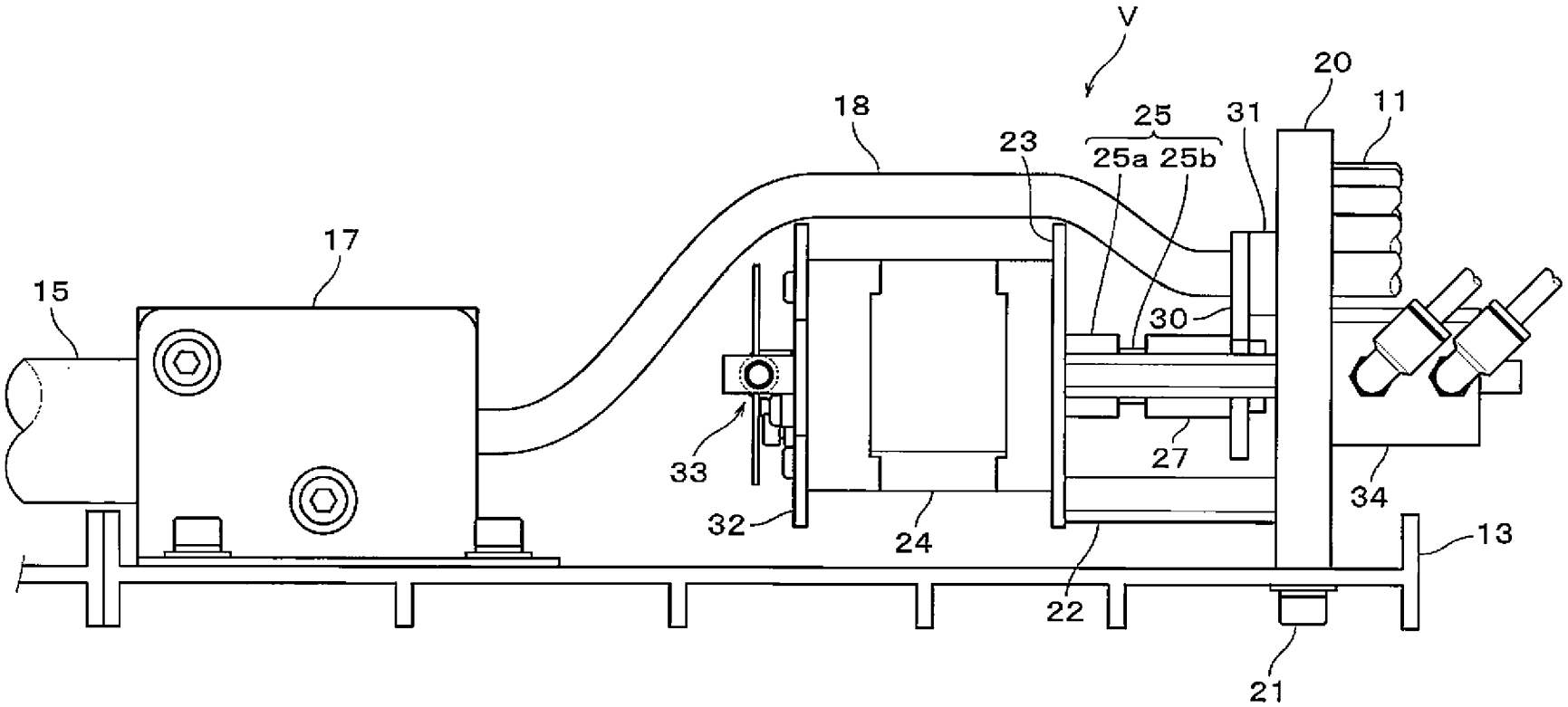
FIG. 2 is a side view of the suction switching apparatus.
Figure 5:
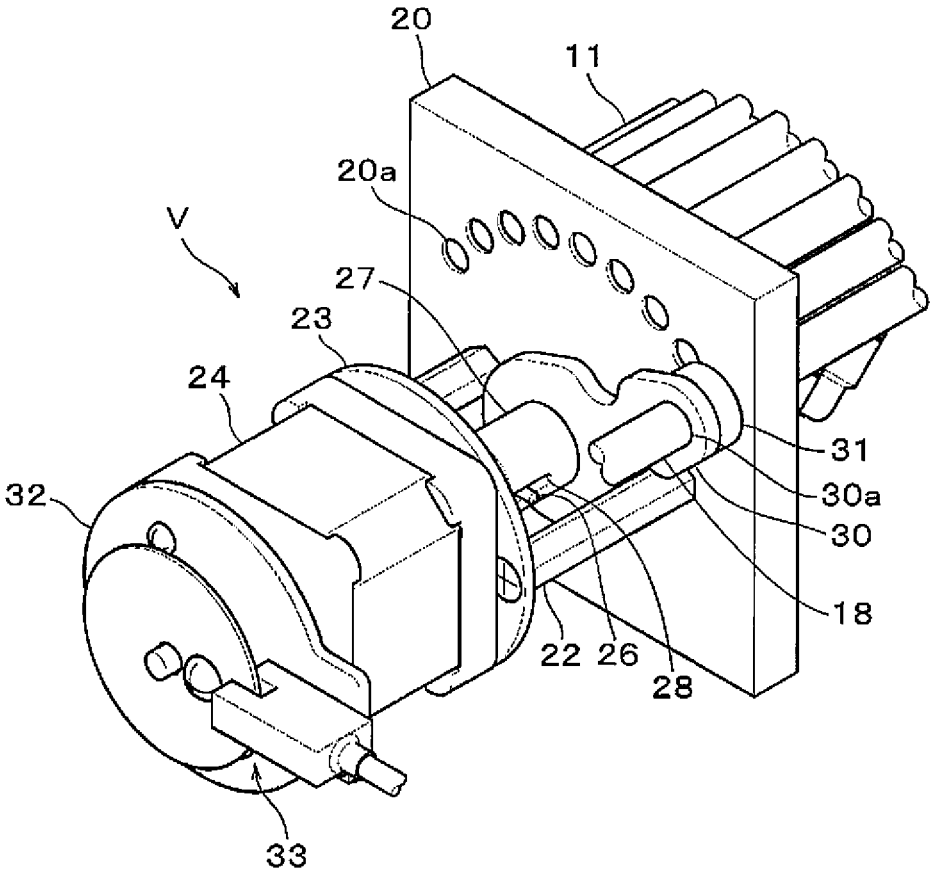
FIG. 5 is a perspective view of the suction switching apparatus.
Figure 11:
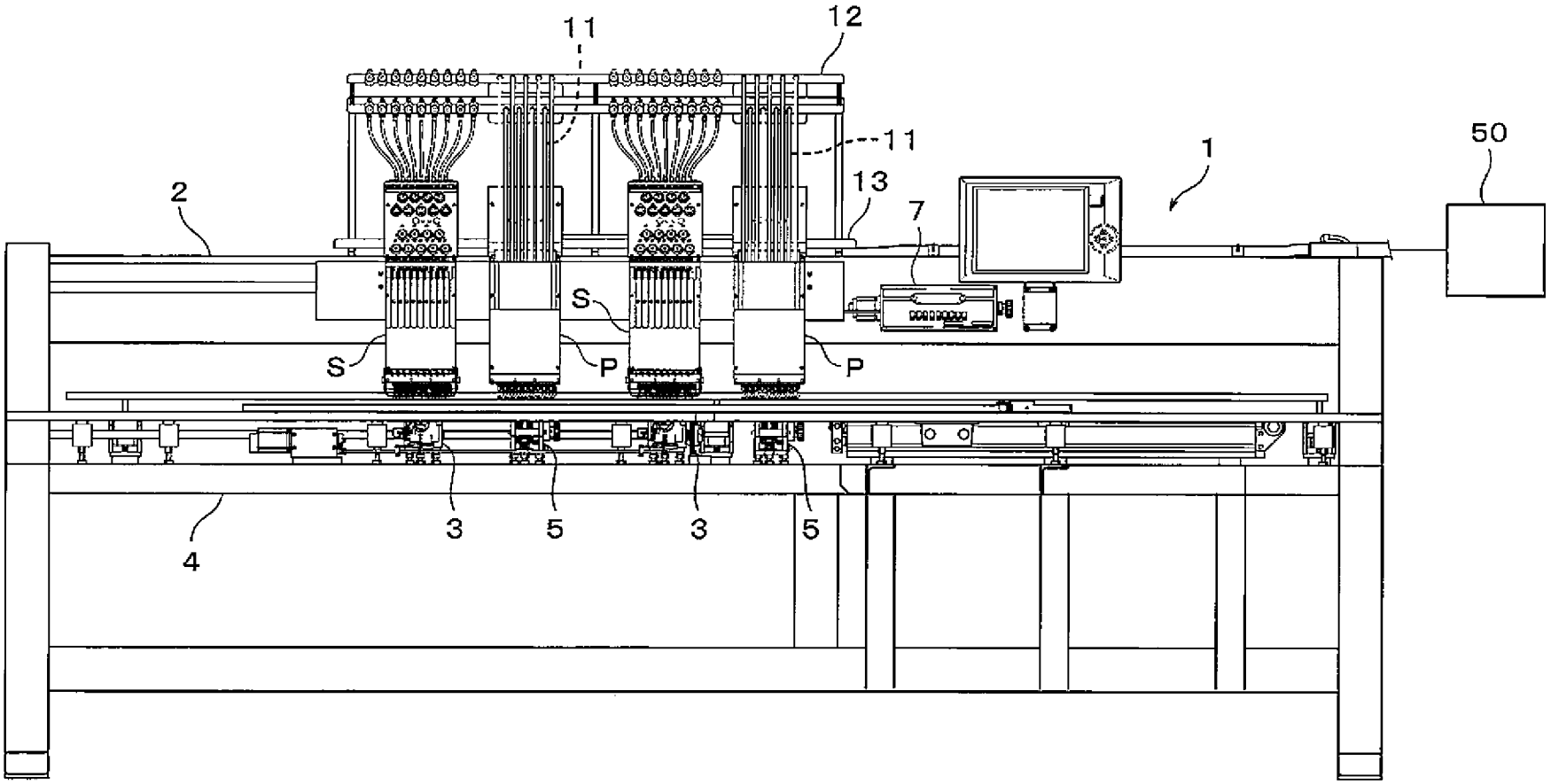
FIG. 11 PRIOR ART
FIG. 11 is a front view of a conventional embroidery sewing machine with punching heads.
Figure 12:
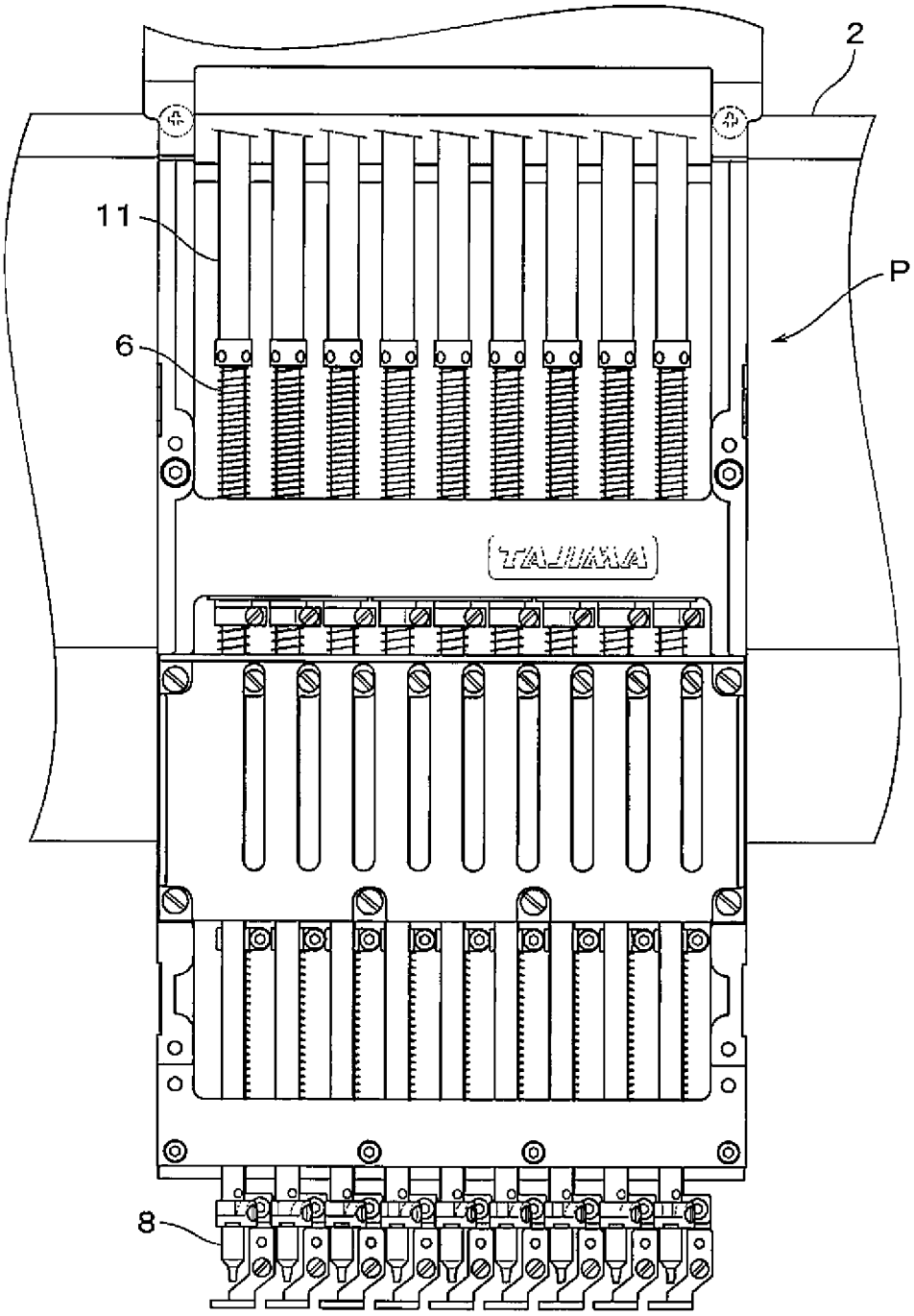
FIG. 12 PRIOR ART
FIG. 12 is a front view of the conventional punching head.
Figure 13:
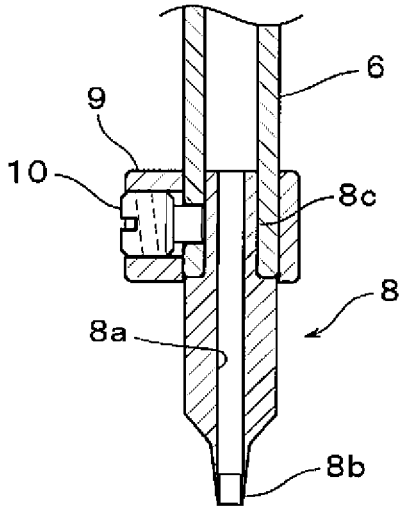
FIG. 13 PRIOR ART
FIG. 13 is a vertical cross-sectional view of a vertically reciprocating needle bar and a punch (punching tool) of the conventional punching head.
Figure 14:
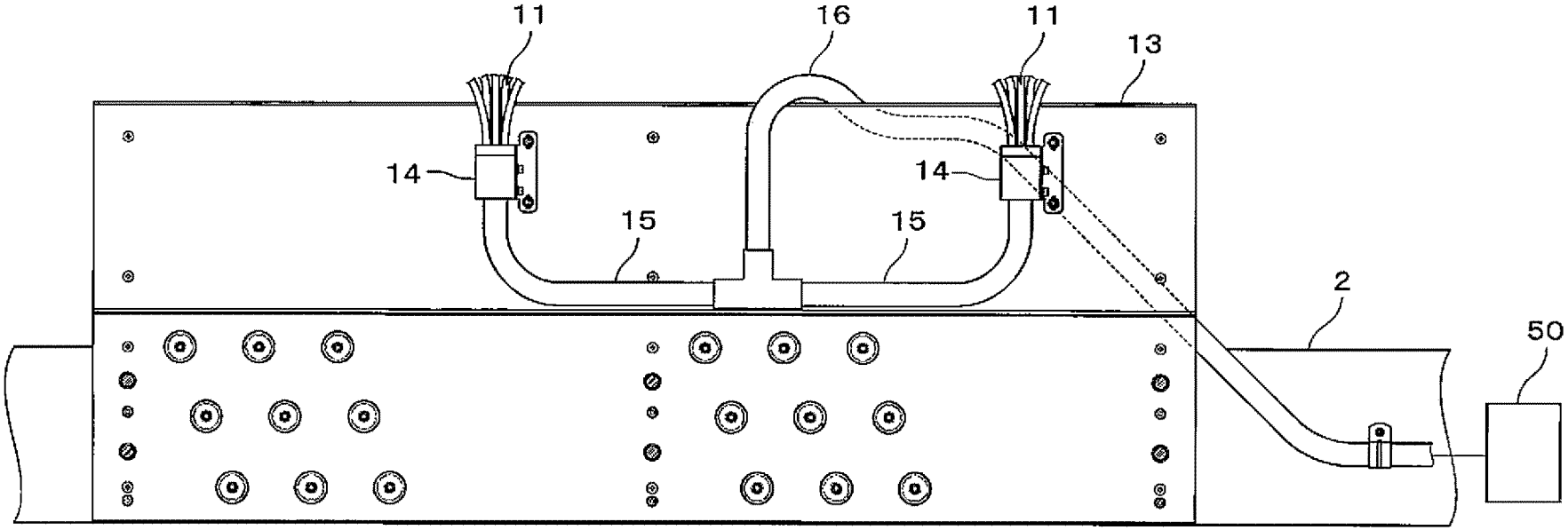
FIG. 14 PRIOR ART
FIG. 14 is a plan view of a part of a conventional suction flow passage.

As shown in FIG. 2, a support plate 20 (described as an embodiment of a connection member) having a plate shape is placed upright on the thread stand plate 13. The support plate 20 is fixed to the thread stand plate 13 by a bolt 21 inserted into the thread stand plate 13 from below. As shown in FIG. 5, the support plate 20 (connection member) is provided with the same number of connection openings 20*a*, which penetrate in the thickness direction, as the number of the punches 8 (and vertically reciprocating needle bars 6) shown in FIG. 12. The connection openings 20*a* are arranged at predetermined intervals along a circular-arc shape. Tubes 11 are connected to rear portions of each of the connection openings 20*a* of the support plate 20, as shown in FIG. 5. The tubes 11 shown in FIG. 12 are connected to the upper ends of the vertically reciprocating needle bars 6 of the punching head P. The connecting sequence of the tubes 11 on the support plate 20 coincide with the arrangement sequence of the punches 8 (and vertically reciprocating needle bars 6) of the punching heads P, as shown in FIG. 11. More specifically, the tube 11 connected to the right-most vertically reciprocating needle bar 6 of the punching head P is connected to the right-most connection opening 20*a* (see, FIG. 5) of the support plate 20 (see, FIG. 5) from a front view. The tube 11 connected to the left-most vertically reciprocating needle bar 6 of the punching head P is connected to the left-most connection opening 20*a* of the support plate 20, etc.

As shown in FIGS. 2 to 5, a stud 22 is placed upright on the front face side of the support plate 20 and an attachment plate 23 is attached to the front end of the stud 22. The attachment plate 23 is provided with a shaft hole (not shown) into which a motor shaft is inserted. The motor shaft passes through the attachment plate 23 and protrudes from the attachment plate 23 toward the support plate 20. A rotary body 25 is fixed at an outer periphery of the motor shaft. The rotary body 25 integrally includes a cylindrical base portion 25*a* and a guide portion 25*b*, the guide portion 25*b* having a smaller diameter than that of the base portion 25*a*. A pin 26 is provided extending through the front end side of the guide portion 25*b*. A movable body 27 is fitted on the outer periphery of the guide portion 25*b*. The movable body 27 has a tubular configuration and is configured to slide in the axial direction and along the outer peripheral surface of the guide portion 25*b* of the rotary body 25. The movable body 27 includes a guide groove 28 into which the pin 26 of the guide portion 25*b* is engaged. The guide groove 28 extends in parallel to the motor shaft. The pin 26 protrudes from the guide groove 28 in a radial direction. Therefore, the movable body 27 moves straight (e.g., advances/retracts) in an axial direction, while being restricted so as not to be rotated by the pin 26 engaged by the guide groove 28. The movable body 27 is also pushed by the pin 26 so as to integrally rotate with the rotary body 25.

As shown in FIGS. 2 to 5, a rotary arm 30 (described as an embodiment of a rotary member) is fixed to the movable body 27 with a connecting tool 29. A base portion of the rotary arm 30 is rotatably supported around the center of the movable body 27. An end portion of the rotary arm 30 is formed with a suction opening 30*a*. The suction opening 30*a* moves to face, in sequence, a plurality of the connection openings 20*a* formed in the support plate 20 in response to a rotation of the rotary arm 30. The suction opening 30*a* is connected to a tube 18 extending from the connection block 17. The opposite side of the suction opening 30*a* is provided with a ring-shaped contact member 31 made of sponge rubber. Further, a detector 33 for detecting a reference position (e.g., an origin point) of the rotary arm 30 is provided on the other side of the motor 24 via an attachment plate 32.

Connection/Disconnection Switching Means (Connection/Disconnection Switching Mechanism)

Figure 3:
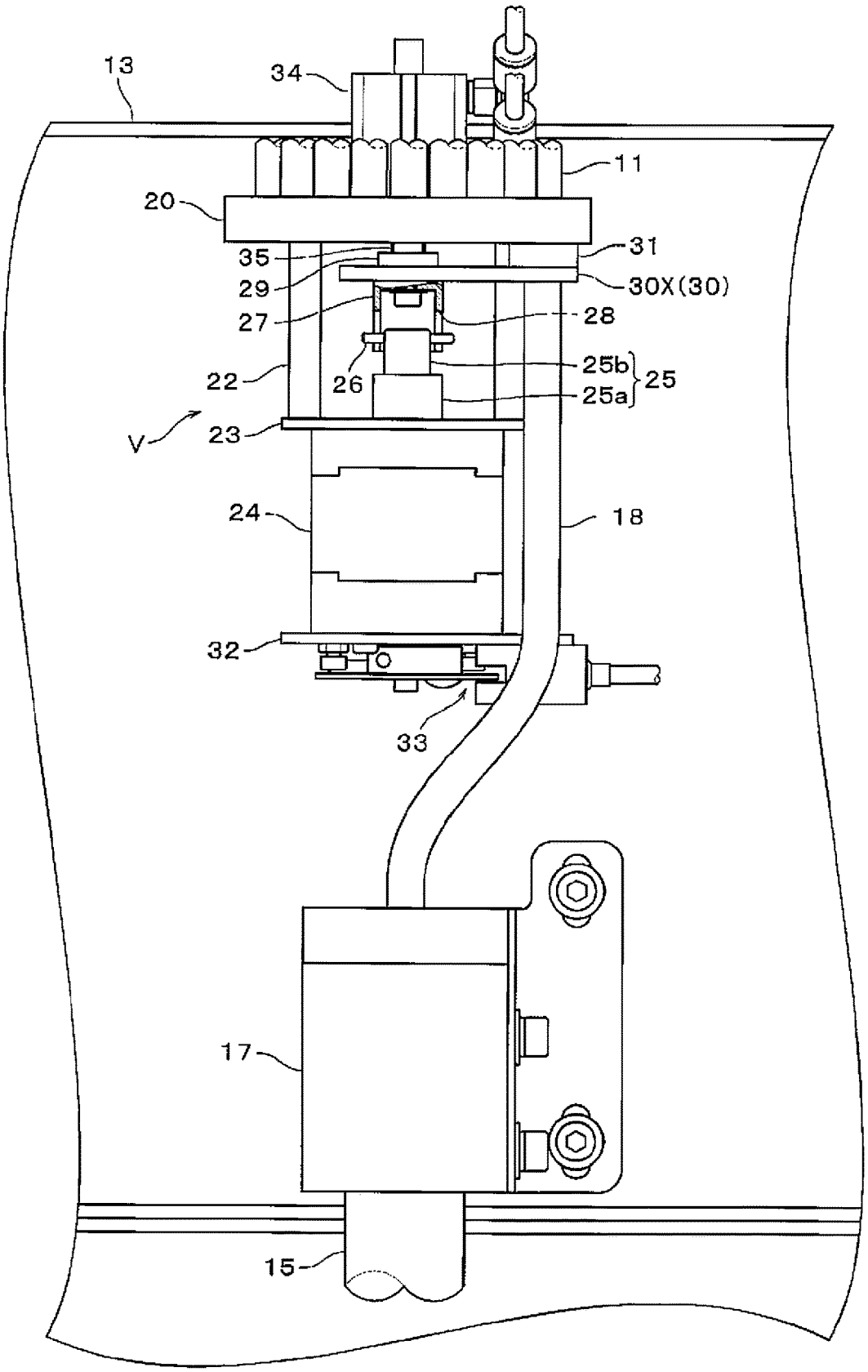
FIG. 3 is an enlarged plan view of the suction switching apparatus.
Figure 4:
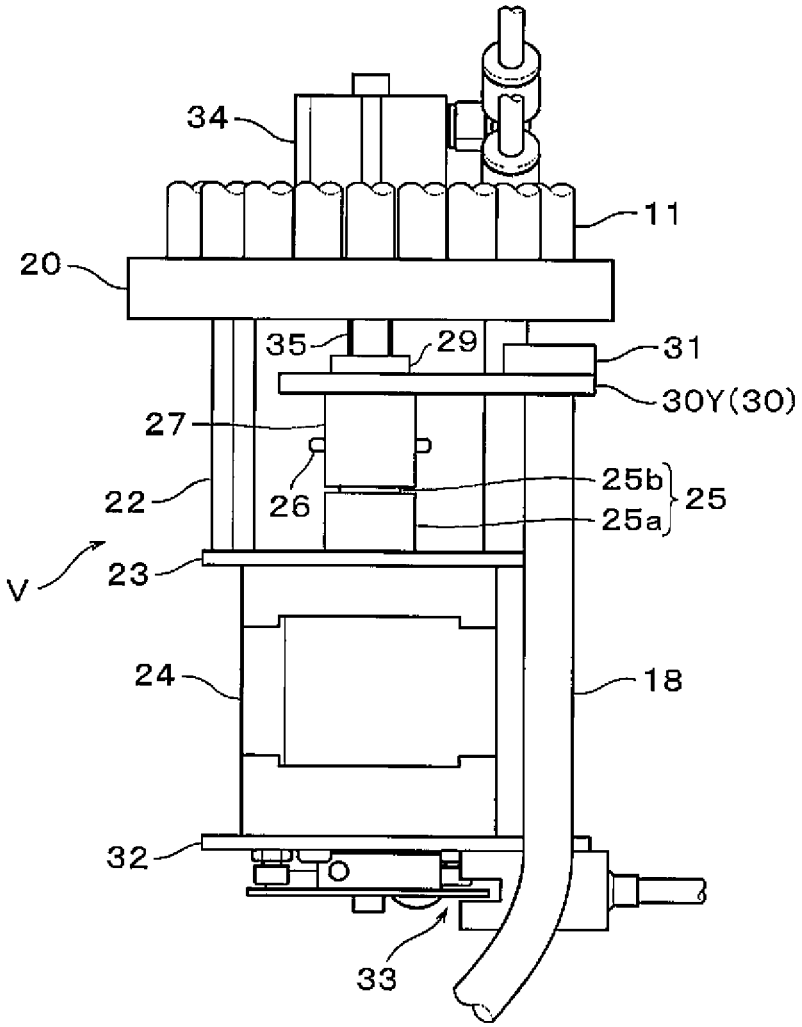
FIG. 4 is a plan view of the suction switching apparatus when a connection/disconnection switching means is operated.

As shown in FIGS. 3 and 4, an air cylinder 34 is attached to a rear surface of the support plate 20. A rod 35 of the air cylinder 34 passes through the support plate 20 and projects forward toward the motor 24. An axis of the rod 35 is collinear with an axis of the motor shaft. A front end of the rod 35 is connected to the connecting tool 29 that fixes the rotary arm 30 to the movable body 27. Therefore, when the rod 35 is advanced or retracted by driving the air cylinder 34, the movable body 27 slides along the guide portion 25*b* of the rotary body 25. In this way, positions of the rotary arm 30 are shifted between a connected position 30X and a retracted position 30Y. More specifically, as shown in FIG. 3, the rotary arm 30 moves toward the support plate 20 (e.g., rearward) when the rod 35 of the air cylinder 34 is retracted. This causes the contact member 31 of the rotary arm 30 to be pressed against the connection opening 20*a* formed in the support plate 20 (e.g., at the connected position 30X). On the other hand, as shown in FIG. 4, the rotary arm 30 moves toward the motor 24 (e.g., frontward) when the rod 35 of the air cylinder 34 is advanced. This causes the contact member 31 of the rotary arm 30 to be disconnected from the connection opening 20*a* (e.g., at the retracted position 30Y).

Operation of Suction Switching Apparatus V

A vacuum apparatus 50 is operated in advance of a punching process to collect the punched chips generated when performing the punching process of a leather sheet, as an example of a workpiece. Subsequently, as is already known, the punching process is carried out for the leather sheet with the punching heads P, while shifting a holding frame that holds the leather sheet on an upper surface of a table in X and Y directions, in accordance with perforation pattern data. During the punching process, the suction switching apparatus is operated as follows.

Figure 6:
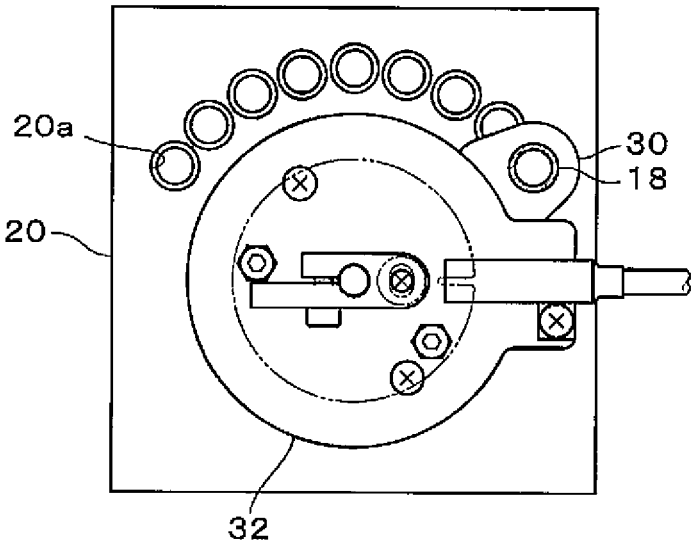
FIG. 6 is a schematic view of the suction switching apparatus when a rotary arm of a flow passage switching means is located at the right-most connection opening.

FIG. 6 shows a position of the rotary arm 30 when carrying out the punching process using a punch 8 which is positioned at the right-most side of the punching head P. The rotary arm 30 moves with respect to the support plate 20 by operating a motor 24. The motor 24 is one component of a flow passage switching means. A rotary arm 30 is aligned with the connection opening 20*a*, into which the connection tube 11 of the punch 8 (and the vertically reciprocating needle bar 6) positioned on the right-most side of the punching head P is inserted. At the same time, as shown in FIG. 3, the contact member 31 of the rotary arm 30 is perpendicularly pressed against the support plate 20 (to the connected position 30X) by operating the air cylinder 34. The air cylinder 34 is one component of the connection/disconnection switching means. Therefore, the first tube 18 and the second tube 11 are connected without a gap, wherein the first tube 18 extends from the connection block 17 to which the branch hose 15 is connected, and the second tube 11 is connected to the punch 8 (and the vertically reciprocating needle bar 6). As a result, only the punch 8 (and the vertically reciprocating needle bar 6) located at the right-most side of the punching head P is sucked by the vacuum apparatus 50, while the airtightness of the flow passage is maintained.

Figure 7:
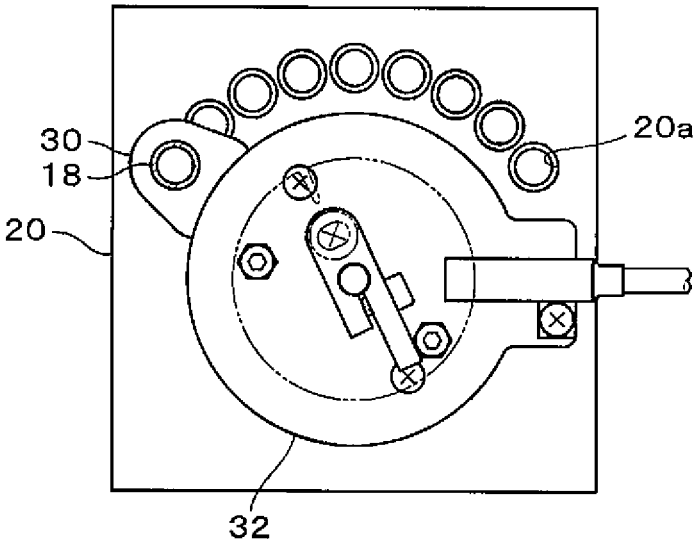
FIG. 7 is a schematic view of the suction switching apparatus when the rotary arm of the flow passage switching means is located at the left-most connection opening.

FIG. 7 shows a position of the rotary arm 30 when the punch 8 performing a punching process is switched from one of the punches 8 to a punch 8 positioned at the left-most side of the punching head P. The contact member 31 of the rotary arm 30 is disengaged from the support plate 20 as the position of the rotary arm 30 is shifted from the connected position 30X (see FIG. 3) to the retracted position 30Y (see FIG. 4) by operating the air cylinder 34. Subsequently, the motor 24 is operated, and the rotary arm 30 rotates in the left direction. The contact member 31 of the rotary arm 30 is rotated to face the connection openings 20*a* connected to the tube 11 of the punch 8 (and the vertically reciprocating needle bar 6) positioned at the left-most side of the punching head P relative to the support plate 20. When the air cylinder 34 is operated, the position of the rotary arm 30 is shifted from the retracted position 30Y to the connected position 30X. This causes the contact member 31 of the rotary arm 30 to be pressed against the support plate 20. As a result, the first tube 18 and the second tube 11 are connected, wherein the first tube 18 extends from the connection block 17 to which the branch hose 15, and the second tube 11 is connected to the punch 8 (and the vertically reciprocating needle bar 6). Thus, the path of the suction flow passage is changed to a path that is connected to the left-most punch 8 (and the vertically reciprocating needle bar 6) of the punching head P. The operation of the suction switching apparatus V (described as an embodiment of switching the suction flow passage) is synchronized with switching the punch 8 (and the vertically reciprocating needle bar 6) to be used. When the punch 8 (and the vertically reciprocating needle bar 6) to be used is switched to one of the punches 8, in accordance with the perforation pattern data, the path of the suction flow passage is also changed to a single corresponding path, so as to be automatically connected to the corresponding punch 8 (and the vertically reciprocating needle bar 6).

As described above, the suction passage leading to the vacuum apparatus 50 is connected to only the corresponding punch 8, of the plurality of punches 8 (and the vertically reciprocating needle bars 6), performing the punching process by the suction switching apparatus V or apparatuses V. Because of this structure, the airtightness of the flow passage can be enhanced as compared to the prior devices, and accordingly punched chips can be efficiently removed by the vacuum apparatus 50.

Second Embodiment

Figure 8:
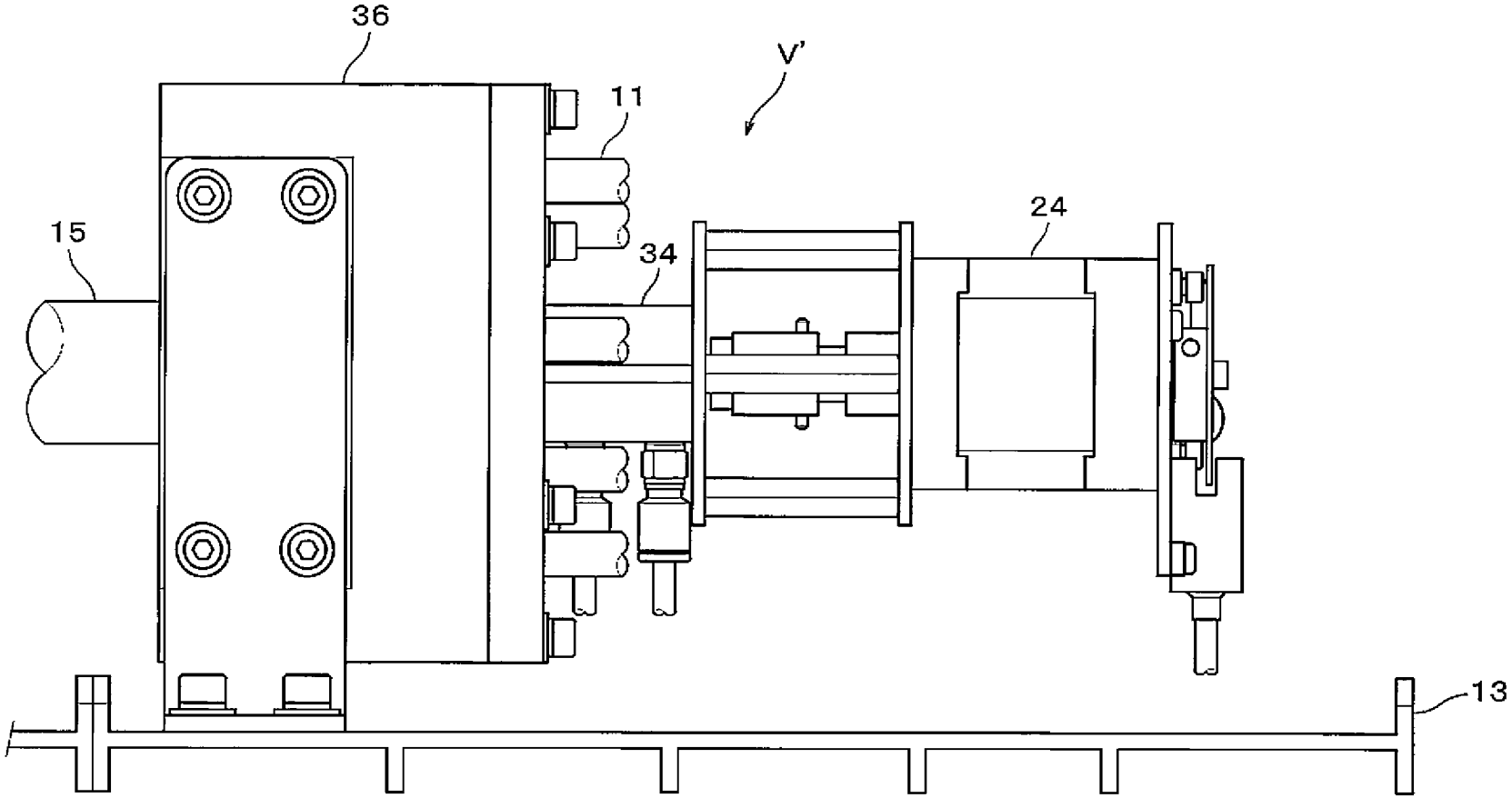
FIG. 8 is a side view of a suction switching apparatus of a punching device according to a second embodiment.
Figure 9:
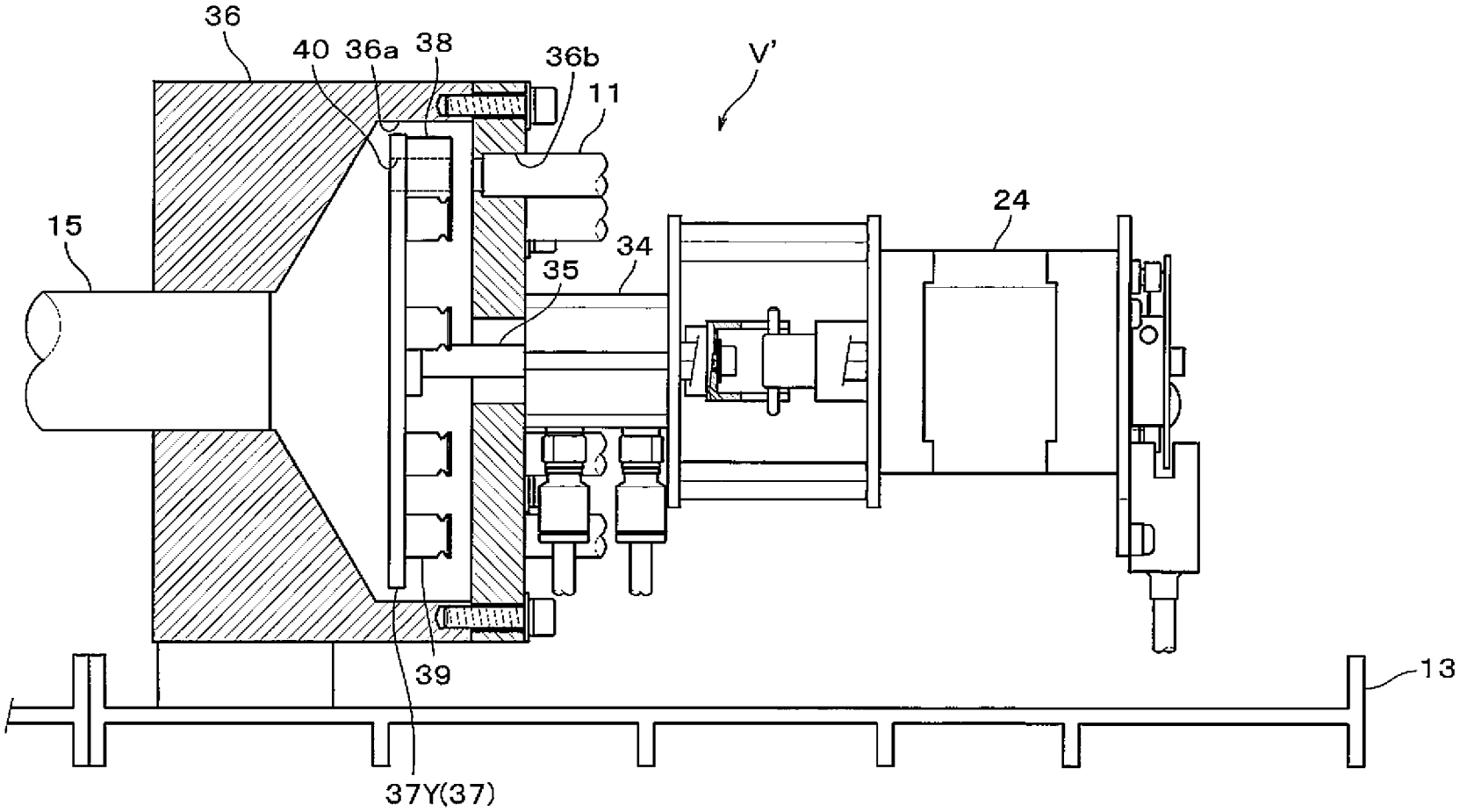
FIG. 9 is a side cross-sectional view of the suction switching apparatus.
Figure 10:
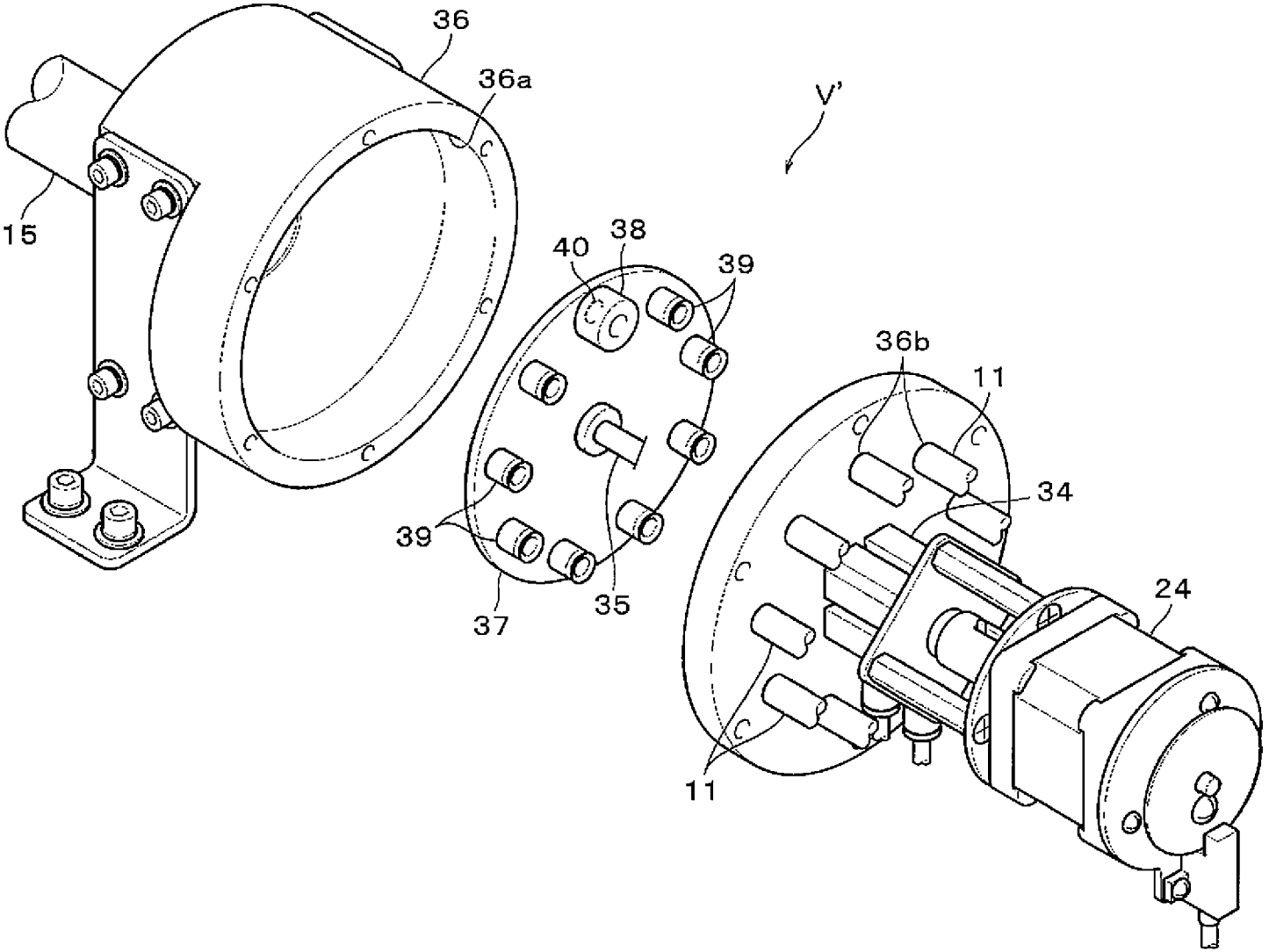
FIG. 10 is an exploded perspective view of the suction switching apparatus.

As shown in FIGS. 8 to 10, a suction switching apparatus V' according to the second embodiment includes a cylindrical manifold 36 (described as an embodiment of a connecting member) with a hollow 36*a* inside. A branch hose 15 leading to a main hose 16 of the vacuum apparatus 50, similar to that shown in FIG. 1, is connected to one side surface of the manifold 36. The opposite surface of the manifold 36 is formed with connection openings 36*b* passing through an interior of the manifold 36. The number of the connection openings 36*b* coincides the number of the punches 8 (and vertically reciprocating needle bars 6) of a punching head P. The connection openings 36*b* are arranged at predetermined intervals along a circular shape. The connection openings 36*b* are correspondingly connected to the tubes 11 that are connected to upper ends of the vertically reciprocating needle bars 6 of the punching head P (e.g., see FIG. 12). A flow passage switching means and a connection/disconnection switching means are provided at a center of the axis around which the connection openings 36*b* are arranged. Further, a rotary plate 37 (described as an embodiment of a rotary member) is provided as a component corresponding to the rotary arm 30 of the first embodiment. The rotary plate 37 (rotary member) is received in the hollow 36*a* of the manifold 36 and is connected to a front end of a rod 35 of an air cylinder 34. The air cylinder 34 is one component of the connection/disconnection switching means.

As shown in FIG. 10, the rotary plate 37 includes one contact member 38 and a plurality of sealing members 39, which are arranged at equal intervals corresponding to the intervals of the connection openings 36*b* and along a circular line positioned concentrically with the circular shape about which the connection openings 36*b* are arranged. The circle line has the same diameter as the circular shape. Similar to the first embodiment, the contact member 38 is made of sponge rubber formed in a ring shape. Further, the rotary plate 37 is provided with a suction opening 40 extending through the thickness direction. The suction opening 40 is provided only where the contact member 38 is attached. The sealing members 39 are formed to have a suction portion at its front end made of rubber and are screwed to the rotary plate 37. They serve as covers for closing each of the connection openings 36*b* of any of punches 8 (and vertically reciprocating needle bars 6) other than the one punch 8 (and vertically reciprocating needle bars 6) performing the perforation process.

As shown in FIGS. 9 and 10, the suction switching apparatus V' according to the second embodiment rotates the rotary plate 37 using the motor 24. The motor 24 is one component of the flow passage switching means, similar to the first embodiment. The position of the rotary plate 37 is shifted such that the contact member 38, which also has the suction opening 40, corresponds to the connection opening 36*b* of the punch 8 (and vertically reciprocating needle bars 6) performing the punching process. Subsequently, similar to the first embodiment, the position of the rotary plate 37 is shifted from the retracted position 37Y to the connected position (not shown) by operating the air cylinder 34. The air cylinder 34 is one component of the connection/disconnection switching means. As a result, the contact member 38 on the rotary plate 37 is pressed against the rotary plate 37 corresponding to the desired connection opening 36*b*. Simultaneously, each of the sealing members 39 is also pressed against the rotary plate 37 at each of the connection openings 36*b* of the punches 8 (and vertically reciprocating needle bars 6) not performing the punching process. Since each of the sealing members 39 closes the connection openings 36*b* of the punches 8 (and vertically reciprocating needle bars 6) not performing the punching process, only the one punch 8 (and vertically reciprocating needle bar 6) performing the punching process is being vacuumed.

The punching devices according to the first and second embodiments have following effects.

The above punching devices include suction switching apparatuses V, V' configured to suck only the vertically reciprocating needle bar(s) 6 performing the punching process. The other vertically reciprocating needle bars 6 (described as an embodiment of hollow rods) are not being vacuumed. This configuration may prevent the vertically reciprocating needle bars 6 that are not performing the punching process from being suctioned. Therefore, the suction power of the vacuum apparatus 50 (suction apparatus) can only act on the vertically reciprocating needle bar(s) 6 which are performing the punching process. As a result, the airtightness in the flow passage for discharging the punched chips may be enhanced, so that the suction efficiency of the vacuum apparatus 50 for vacuuming the punched chips may be improved.

Further, the suction switching apparatuses V, V' include a flow passage switching means for changing a path of the flow passage in response to selection of a vertically reciprocating needle bar 6 out of the plurality of the vertically reciprocating needle bars 6. This configuration may allow for suction of only the flow passage corresponding to the vertically reciprocating needle bar 6 performing the punching process, out of the plurality of the vertically reciprocating needle bars 6.

Further, the suction switching apparatuses V, V' include a connection/disconnection switching means for switching between a connection and disconnection state at an intermediate portion of the path of the suction flow passage. The flow passage may be changed by the flow passage switching means. Therefore, the path of the suction flow passage may be physically changed, so as to be connected to or disconnected from the selected vertically reciprocating needle bars 6 by the flow passage switching means.

Further, after the connection/disconnection switching means disconnects the suction flow passage, the flow passage switching means changes the path of the flow passage to select the path of the suction flow passage corresponding to the next selected vertically reciprocating needle bar 6, out of the plurality of the vertically reciprocating needle bars 6 (hollow rods). This structure may prevent the contact members from being worn and may reduce the load applied to the motor 24 (drive source), etc., as compared to a switching structure that changes a path of the flow passage without disconnecting the flow passage.

Further, the flow passage switching means includes a plurality of the connection openings 20*a*, 36*b* disposed along a circular-arc line. This allows for a more compact structure than that in which the plurality of the connection openings 20*a*, 36*b* are arranged along a straight line. Further, the flow passage switching means utilizes a rotary shaft of the motor 24 (or drive source) for switching the suction openings 30*a*, 40 with respect to the plurality of the connection openings 20*a*, 36*b*. This structure may allow the flow passage switching means to be more compact, without adopting a complex structure for the flow passage switching means.

When the rotary arm 30 or the rotary plate 37 of the connecting/disconnecting switching means reciprocally moves coaxially along their center of rotation, the plurality of the connection openings 20*a*, 36*b* and the suction opening 30*a*, 40 are connected or disconnected to the rotary arm 30 or the rotary plate 37. This configuration allows the contact member provided at the suction opening 30*a*, 40 to be perpendicularly pressed against one of the connection openings 20*a*, 36*b*. As a result, the suction openings and the connection openings are connected without a gap, such that the airtightness can be ensured.

Further, each suction switching apparatus V, V' may be provided for each of the punching heads P. Therefore, even when the number of punching heads P is increased, the suction switching apparatus V, V' may accommodate each of the increased number of punching heads P. Consequently, this structure can be flexibly adapted to a change in the number of the punching heads P, while the suction processing capability can also be ensured.

The embodiments of the present invention have been described above, however, the punching devices of the present invention shall not be limited to the present embodiments and may be carried out in various other configurations.

The present embodiments are provided with two pairs of an embroidery head S and a punching head P, however, this shall not be limited thereto. Instead, other embodiments may be an embroidery sewing machine with more than two pairs, a punching device with a plurality of only punching heads P, or a punching device with only one punching head P.

The invention claimed is:

1. A punching device, comprising:

a punching head including punching tools, each of the punching tools having an axially extending through hole;

a suction apparatus comprised of a vacuum is configured to suck a punched chip generated during a punching process by one of the punching tools;

a suction switching apparatus configured to increase a suction in the punching tool performing the punching process, as compared to the punching tool(s) not performing the punching process, said suction switching apparatus comprises a flow passage switching mechanism configured to change a path of a suction flow passage such that the suction of the punching tool performing the punching process can be increased; and wherein the flow passage switching mechanism comprises:

a connection member formed with connection openings disposed along a circular arc line; and a rotary member formed with a suction opening which selectively communicates with one of the connection openings in accordance with a rotation of the rotary member about a center of the circular arc line as a rotational center thereof.

2. The punching device as claimed in claim 1, wherein the suction switching apparatus further comprises a connection/disconnection switching mechanism configured to disconnect a path of a suction flow passage between the punching tool performing the punching process and the suction apparatus, wherein the rotary member includes a rotary arm or a rotary plate, the rotary member operated by an air cylinder.

3. The punching device as claimed in claim 1, wherein the suction switching apparatus further comprises a connection/disconnection switching mechanism positioned at an intermediate portion of that path of the suction flow passage, which is changed by the flow passage switching mechanism, wherein the connection/disconnection switching mechanism is configured to reciprocally move in an extending direction of the suction flow passage so as to change the path of the suction flow passage between in a connected state and a disconnected state with respect to the selected punching tool through hole or holes.

4. The punching device as claimed in claim 3, the flow passage switching mechanism is configured to change the path of the suction flow passage in accordance with a selected punching tool through hole or holes among the punching tool through holes, when the connection/disconnection switching mechanism disconnects the suction flow passage.

5. The punching device as claimed in claim 1, wherein the suction switching apparatus further comprises a connection/disconnection switching mechanism configured to reduce the suction in the punching tool after the punching tool performed the punching process, said connection/disconnection switching mechanism positioned intermediate along a suction path to seal and unseal a connection opening for the punching tool.

6. The punching device as claimed in claim 1, wherein the suction switching apparatus further comprises a connection/disconnection switching mechanism configured to shift the suction opening by moving the rotary member reciprocally and coaxially along the rotational center.

7. The punching device as claimed in claim 1, further comprising:

a second punching head including second punching tools, each of the second punching tools having an axially extending through hole; and a second suction switching apparatus configured to increase a suction in one of the second punching tool performing a punching process, as compared to the second punching tool(s) not performing the punching process.

8. The punching device as claimed in claim 7, wherein the punching processes of the first and second punching tools occur simultaneously.

9. The punching device as claimed in claim 1, wherein the suction switching apparatus is further configured to:

decrease the suction in the punching tool after it has performed the punching process; and increase a suction in another punching tool performing a second punching process, as compared to the punching tool(s) not performing the second punching process, including the punching tool that previously performed the punching process.

10. A punching device, comprising:

a punching head including a first hollow rod with a first punching tool and a second hollow rod with a second punching tool, the first and second hollow rods each having an axially extending through hole;

a suction apparatus configured to create a suction flow path along a first path including the through hole of the first hollow rod or a second path including the through hole of the second hollow rod;

a suction switching apparatus configured to change the suction flow path from the first path to the second path, said suction switching apparatus comprises a connection/disconnection switching mechanism configured to reduce a suction along the first path prior to the suction switching apparatus changing the suction flow path to the second path; and wherein the first path includes a first end connected to the suction switching apparatus, the second path includes a second end connected to the suction switching apparatus, said suction flow path being positionably rotated by a motor having a shaft, so as to selectively engage the first path or the second path, and the first end and the second end are located along a circular-arc line around the motor shaft extending in an axial direction.

11. The punching device as claimed in claim 10, wherein the first hollow rod performs a first punching process prior to the suction switching apparatus changing the suction flow from the first path to the second path.

12. The punching device as claimed in claim 11, wherein the second hollow rod performs a second punching process after the suction switching apparatus changes the suction flow from the first path to the second path.

13. A punching device, comprising:

a punching head including a first hollow rod with a first punching tool and a second hollow rod with a second punching tool;

a first tube connected to the first hollow rod, and the first tube having a first opening at an end;

a second tube connected to the second hollow rod, and the second tube having a second opening at an end;

a rotary member having at least one suction opening and at least one sealing member, the rotary member being configured to rotate so as to selectively align the at least one sealing member to close the first opening or the second opening, and align the at least one suction opening to open the other of the first opening or second opening;

a suction apparatus communicating with the suction opening to define a suction passage with the first or second opening, and wherein the first opening and the second opening are positioned on a circular-arc line and the rotary member rotates along the circular arc line.

14. The punching device as claimed in claim 13, wherein a suction force in the first punching tool is greater than a suction force in the second punching tool when the second opening is closed by the sealing member.

15. The punching device as claimed in claim 13, wherein the sealing member is configured to move between in a position apart from both the first opening and the second opening and in a position where the first opening or the second opening is selectively closed.

* * * * *